United States Patent [19]

Saltwick et al.

[11] Patent Number: 4,972,469

[45] Date of Patent: Nov. 20, 1990

[54] SYSTEM AND METHOD FOR COMMUNICATIONS SECURITY PROTECTION

[75] Inventors: John M. Saltwick, Phoenix; Dean Scarinci, Glendale; William O. Sparks, Cave Creek; Geoffrey W. Gates, Phoenix, all of Ariz.

[73] Assignee: Syntellect Inc., Phoenix, Ariz.

[21] Appl. No.: 523,121

[22] Filed: May 14, 1990

Related U.S. Application Data

[63] Continuation-in-part of Ser. No. 354,261, May 19, 1989.

[51] Int. Cl.[5] ..... H04K 1/02

[52] U.S. Cl. ..... 380/2; 380/6

[58] Field of Search ..... 380/2, 6

[56] References Cited

U.S. PATENT DOCUMENTS

| | | | |
|---|---|---|---|
| 3,600,685 | 3/1969 | Doyle | 455/1 |
| 3,624,297 | 3/1972 | Chapman | 380/6 |
| 3,651,268 | 3/1972 | Rivkin | 380/6 |
| 3,654,604 | 4/1972 | Crafton | 380/23 |
| 3,718,765 | 2/1973 | Halaby | 380/6 |
| 3,985,958 | 10/1976 | dudley | 380/6 |
| 4,160,875 | 7/1979 | Kahn | 380/6 |
| 4,393,276 | 7/1983 | Steele | 380/6 |
| 4,468,667 | 8/1984 | Baylor | 380/6 |
| 4,625,081 | 11/1986 | Lotito | 379/88 |
| 4,727,568 | 2/1988 | Morishinia | 380/6 |
| 4,753,205 | 2/1986 | Nash | 380/6 |
| 4,901,348 | 2/1990 | Nichols et al. | 380/6 |

*Primary Examiner*—Salvatore Cangialosi

*Attorney, Agent, or Firm*—Gottlieb, Rackman & Reisman

[57] ABSTRACT

A system and method are disclosed for preventing intelligible interception of information signals transmitted over a two-direction line. A masking signal is applied through a hybrid circuit at the receiving end of the line, and this masking signal, which appears on the line together with the information signal, prevents intelligible decoding. The masking signal includes a series of frequencies which are sequentially applied. Only at the receiving end of the line, where the hybrid circuit attenuates the masking signal which it receives at its receive port, can intelligible decoding take place. The amplitude of the information signals is sensed at the receiving end and the amplitude of the masking signals on the line is adjusted to be great enough to provide security, by confusing an eavesdropping detector, yet small enough at the receiving end so that the receiving detector is not confused.

16 Claims, 9 Drawing Sheets

SYSTEM AND METHOD FOR COMMUNICATIONS SECURITY PROTECTION

This application is a continuation-in-part of application Ser. No. 07/354,261 filed May 19, 1989.

This invention relates to communications systems, and more particularly to security protection arrangements therefor.

The use of the public telephone system for computer communications and other data services is widespread. Services which are provided involve access to bank accounts, credit limit reporting, credit card transactions, and order entry functions.

Communications are typically accomplished by encoding data to be transmitted as data signals. Examples of encoding are frequency shift keying (FSK), phase shift keying (PSK), and other forms of modulation using modems. Among the more popular forms of transmission are dual tone multi-frequency data (DTMF), commonly called Touchtone, and multi-frequency (MF) data encoding.

In order for a caller to access specific information it is usually necessary for the caller to enter an identifying number, such as an account number. For sensitive transactions such as funds transfer, accepted security procedures also require the entry of a security code, commonly known as a personal identification number or PIN. When transmitted, the account number and PIN are subject to compromise by someone eavesdropping on the communications line with a decoding device.

It is the primary object of this invention to provide a security system which makes it difficult or impossible to compromise security by eavesdropping on the telephone connection during the transmission of sensitive data.

In accordance with the principles of our invention, a masking signal is transmitted from the receiving unit during input of sensitive information at the sending device. A masking signal, as used herein, is a signal which tends to disable or confuse an eavesdropping detector. Examples are signals which distort the information signal; add to the frequency spectrum, amplitude and/or phase of the information signal; or are similar to the information signal so that a detector captures false information. The receiving unit is equipped with a means for canceling out the masking signal so that its signal detector is able to detect the information which was sent reliably and accurately. The cancellation of the masking signal is performed at the receiving site because the cancellation depends on knowledge of the specific characteristics of the masking signal and they may vary over time, e.g., in frequency, amplitude and/or phase.

Also in accordance with the invention, the level of the information signal and/or the characteristics of the transmission media (e.g., the impedance of the telephone line) may be measured. The first portion of the information signal received (e.g., the first tone) may be used to select at least an initial characteristic of the masking signal (e.g., the amplitude) so that the masking signal strikes a compromise between providing security which is not confusing to the receiving unit, and meeting government regulations with respect to permissible transmission levels.

The exact nature of the masking signal depends on the encoding technique used for the information signal to be protected. One common way of encoding numeric information is to use the dual tone multi-frequency scheme (DTMF). In this scheme, the keypad comprises four rows of four buttons each. Each row and column has a unique frequency associated with it. Depressing a key sends a signal consisting of the corresponding row frequency and column frequency. For example, the digit 1 is sent as a signal composed of tones at 697 Hz and 1209 Hz. A DTMF detector decodes a valid digit only when it receives exactly one row frequency and one column frequency. If two or more row or column tones are detected simultaneously, or in some cases if a tone which is not either a row or column tone is detected, the signal is not recognized as a valid DTMF digit. This scheme is used to prevent the improper detection of voice as a valid digit.

In order to mask the transmission of DTMF digits, a masking signal consisting of at least two row tones or two column tones can be used. Thus, no matter what row and column tones characterize a transmitted digit, an eavesdropper would detect at least three tones on the transmission line with no way to determine which two constitute the actual DTMF digit.

Another common data encoding technique is frequency shift keying (FSK). In this method, two or more carrier frequencies are used to encode binary data. With a tone of 980 Hz encoding a "mark", and a tone of 1180 Hz encoding a "space", a masking signal consisting of the 980 Hz and the 1180 Hz carrier frequencies could be used. In full duplex FSK, only the originate "mark" and "space" may need to be masked to provide security for the sending device.

Further objects, features and advantages of our invention will become apparent upon consideration of the following detailed description in conjunction with the drawing, in which.

Figure 1:
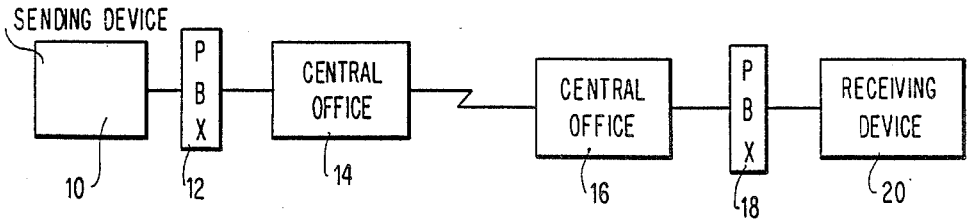
FIG. 1 depicts symbolically the type of communications over the public telephone system with which the present invention is concerned.
Figure 8:
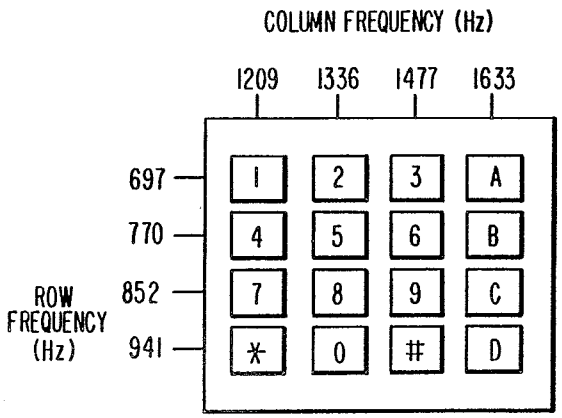
FIG. 8 depicts the row and column frequency assignments commonly used in the DTMF signaling scheme.

FIG. 1 depicts a typical data communications path over the switched public telephone network. The sending device 10 may be a telephone instrument capable of transmitting DTMF signals, or it may be a more sophisticated automated device such as a credit card transaction terminal. FIG. 8 depicts a typical DTMF keypad, along with the row and column frequency assignments which are in common use. The receiving device 20 in FIG. 1 is typically a computer, with a front end processor often connecting the computer to the telephone line. As is well known in the art, the path may be established over trunk lines between two or more central offices 14, 16. There may also be other intervening facilities, such as PBXs 12, 18.

Figure 2:
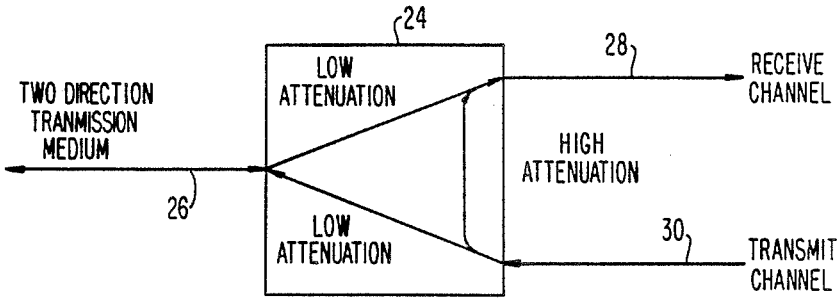
FIG. 2 depicts symbolically a device known as a "hybrid" whose use is standard in the telephone art.
Figure 3:
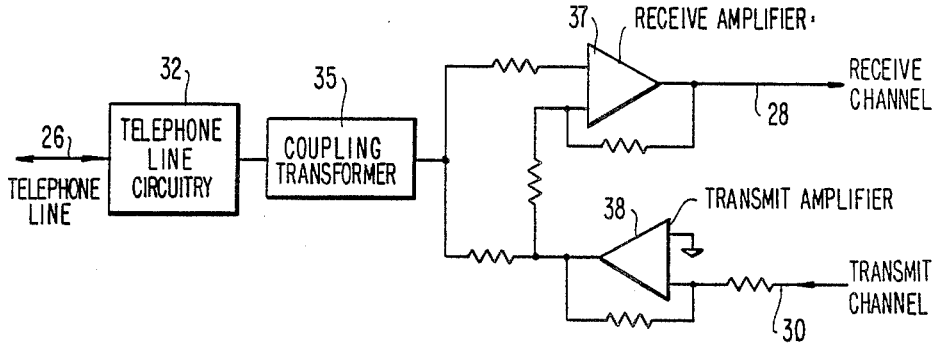
FIG. 3 is a more detailed representation of a conventional hybrid device.

A hybrid circuit is a three-port device, as shown in FIG. 2. One port 26 is a bi-directional transmit and receive channel. A receive-only channel and a transmit-only channel make up the other two ports 28, 30. The function of the hybrid 24 is to separate the bi-directional transmit/receive port into respective transmit and receive channels. The more detailed drawing of FIG. 3 shows one way in which a hybrid may subtract the signal on the transmit channel from the signal at the bi-directional port to give rise to the signal on the receive channel. The key to the operation of the hybrid is that the signal at the output of transmit amplifier 38 is extended to the inverting input of differential amplifier 37; this receive amplifier subtracts the signal on the transmit channel from the signal on telephone line 26 (which is typically coupled to the hybrid through a coupling transformer 35 and other telephone line circuitry 32). The hybrid circuit can be characterized by the attenuations between the three ports, as depicted in FIG. 2. The basic idea is that a signal on the transmit channel is highly attenuated on its way to the receive channel; in other words, signals from the transmit channel are extended with relatively low attenuation to the telephone line, and signals on the telephone line are extended with relatively low attenuation to the receive channel, while very little of the signal which originates on the transmit channel appears on the receive channel.

A typical use of a hybrid circuit would be in a central office, such as central office 16 in FIG. 1. But the connections shown in FIGS. 2 and 3 would in this case be reversed. The transmit and receive channels are typically trunk channels, while the telephone line is extended to the PBX 18 or directly to the receiving device 20. Two-way signals typically appear on the telephone line extended to a handset, while separate paths are provided over trunks for signals transmitted in the two different directions. In our invention, however, a hybrid circuit is poled in the direction shown in FIGS. 2 and 3.

Figure 4:
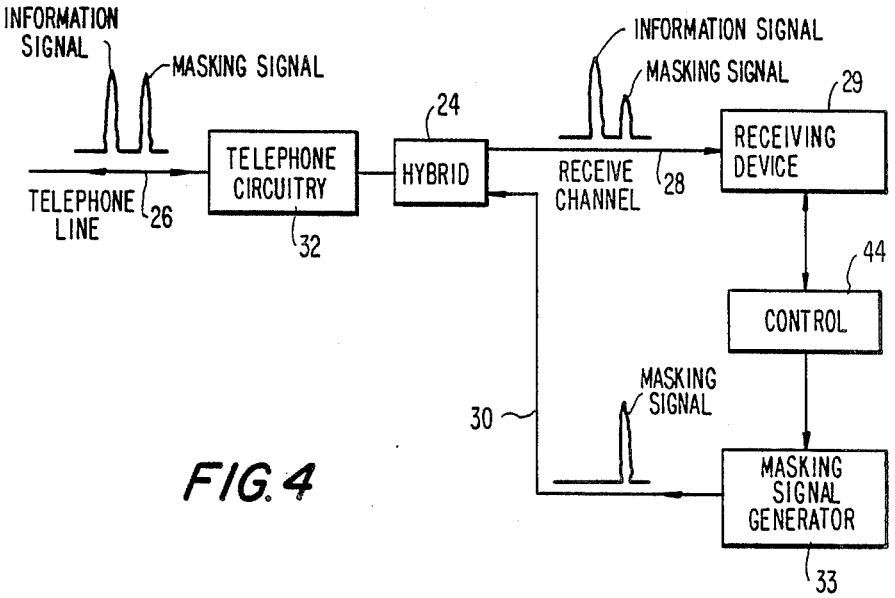
FIGS. 4–7 depict four embodiments of our invention.

The most elementary form of the invention is shown in FIG. 4. In data communications a hybrid 24 is sometimes used anyway. Receive channel 28 is shown extended to a receiving device 29, which is typically a DTMF detector at the data processing site. Very often it is necessary to transmit signals to the sending device, typically automated voice signals under the control of the data processor. For this purpose a transmit channel 30 is utilized, and hybrid 24 serves to couple transmitted signals to telephone line 26, and to couple signals on the telephone line to the receiving device over channel 28. The hybrid serves to attenuate the transmitted signals on channel 30 such that they appear at a much lower level on the receive channel 28. As shown in FIG. 4, a masking signal generator 33 is used to apply a masking signal on channel 30. The characteristics of the masking signal generated by masking signal generator 33, which is essentially a digital-to-analog converter, are controlled by a controller 44, which supplies control bits via a data bus 36, in accordance with characteristics of the line and the information signal, as more fully described below.

Voice or even data signals may also be applied on channel 30, but the significant thing about masking signal generator 33 is that it applies a masking signal on channel 30 at the time that the sending device 10 of FIG. 1 transmits sensitive data in the opposite direction to the receiving device. The masking signal is shown symbolically in FIG. 4, and it appears together with the information signal transmitted in the opposite direction on line 26. The representation of the masking signal and the information signal is in the frequency domain (amplitude verses frequency).

The function of hybrid 24 is to reduce the amplitude of the masking signal relative to that of the information signal on receive channel 28. It is in this way that the receiving device can discriminate between the information and masking signals, while an unauthorized tapping of line 26 will not result in intelligible interception of the information signal.

The simple hybrid arrangement of FIG. 4 can be augmented by signal processing. The signal processing can take two forms, one shown in FIG. 5 and the other shown in FIG. 6. The most sophisticated system is that of FIG. 7, in which both forms of signal processing are used. The object of the additional signal processing is to allow a more "confusing" masking signal to appear on line 26. The problem with the masking signal becoming more and more confusing—if sufficient signal processing is not employed—is that that portion of it which does appear in the receive channel may confuse the receiving device; that is because no hybrid circuit is perfect and some small part of the masking signal will almost always appear in the receive channel, an effect known as "sidetone". (To the extent that the telephone network produces an echo, even in the absence of sidetone, the masking signal which is transmitted back from the sending site to the receiving site is not attenuated by the hybrid circuit, and thus if the telephone network is not "perfect" there will invariably be some portion of the masking signal in the receive channel because what is received as an echo is treated as part of the information signal transmitted by the sending device.) Signal processing is most conveniently implemented by using standard digital signal processing integrated circuits, such as the Texas Instruments TMS320C25 integrated circuit. There are standard echo cancellation and sidetone cancellation algorithms used in the art, and these types of algorithm can be used in the more sophisticated embodiments of the invention shown in FIGS. 6 and 7. It is to be understood, however, that analog signal processing techniques can also be used. In any event, the embodiment of FIG. 5 requires relatively unsophisticated signal processing.

In the hybrid approach, the masking signal should be properly adjusted so as not to block detection of the information signal at the receiving end. Due to the dynamic range of possible incoming DTMF signals (typically 30 db), and assuming a relatively simple hybrid with a rejection of 10 to 20 db, it may be difficult to determine a single level of masking signal which will provide interference for eavesdropping detectors yet allow detection of all DTMF signals at the receiving end. For proper detection at the receiving end, it is preferable that the masking signal in the receive channel be approximately 15 db below the incoming information signal for any level of the information signal.

Figure 5:
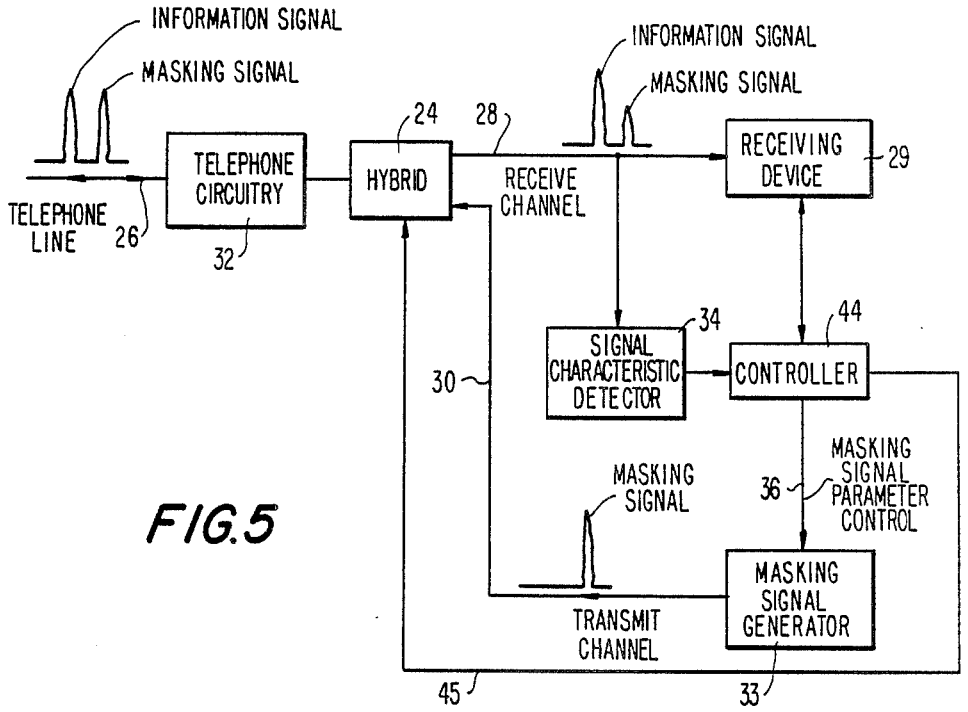

A more preferred embodiment of the hybrid approach therefore provides means for monitoring the incoming DTMF signal for its energy content before transmitting the masking signal, as shown in FIG. 5. The energy content may be checked on the first DTMF input, and it defines the necessary output level of the masking signal. The output level of the masking signal in this embodiment is dependent on the first input and remains constant throughout the call, during necessary input fields. After the last field of sensitive information has been accepted, the masking signal is disabled. Other schemes may be adapted to recalibrate at each input during a particular call if the characteristics of the medium vary during the call.

The signal processing is governed in the embodiment of FIG. 5 by signal characteristic detector 34. This element may be any standard device for checking a characteristic of the information signal (or even of the masking signal as it appears on the receive channel), such as its peak amplitude, and for applying a signal indicative thereof to the controller 44 which in turn provides a control signal for adjusting the masking signal generator 33. Signal characteristic detector 34 digitizes the incoming information signal and may use any conventional A/D converter, such as an Intel 2913 coder/decoder, running at a sampling rate of, for example, 8,000 samples per second.

The form of the invention shown in FIG. 5 is not truly a feedback arrangement. What is monitored is a characteristic of the information (or masking) signal, and what is controlled is a parameter (such as amplitude) of the masking signal. The larger the level of the information signal on the receive channel, the larger the level of the masking signal which can be tolerated on the receive channel. This allows the amplitude of the masking signal applied to the transmit channel to be increased. This process allows for maximizing the level of the transmitted masking tones, thus increasing the difficulty of intelligible interception of the information signal.

There is also a control line 45 from controller 44 to hybrid 24. Controller 44 generates a control signal which alters parameters in hybrid 24 so that it provides maximum attenuation between transmit channel 30 and receive channel 28, by adjusting hybrid 24 to accommodate itself to the impedence of line 26, as more fully explained below.

Figure 6:
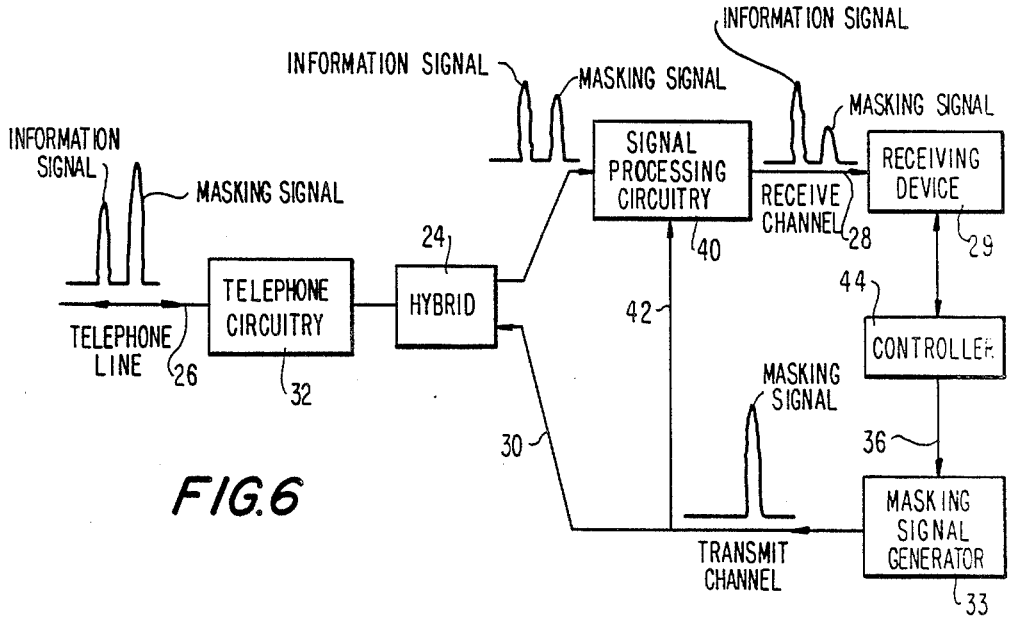

A more sophisticated form of signal processing is shown in FIG. 6. Here, signal processing circuit 40 subtracts a signal which is a function of the masking signal extended to it over conductor 42 from the received signal which is derived from hybrid circuit 24. Comparing FIGS. 5 and 6, the masking signal in FIG. 6 is shown larger in amplitude. Referring to FIG. 5, the information and masking signal levels on telephone line 26 are shown to be equal. (This is purely for the sake of convenience, it being understood that it is probably unlikely that they would be exactly equal in actual practice.) Because the masking signal on transmit channel 30 is greater in amplitude in the embodiment of FIG. 6, the masking signal is shown larger than the information signal on telephone line 26, thus making it more difficult to achieve intelligent interception of the information signal. Hybrid 24 reduces the amplitude of the masking signal which appears at the receive-only port, but because a larger masking signal was used in the first place, it will be apparent that the masking signal amplitude relative to that of the information signal amplitude relative to that of the information signal is greater at the output of the hybrid in FIG. 6 than at the output of the hybrid in FIG. 5. It is signal processing circuitry 40 which further attenuates the level of the masking signal by subtracting a replica of the masking signal which appears on conductor 42 from the composite signal applied to the input of the signal processing circuitry. As shown in FIG. 6, the relative amplitudes of the information and the masking signals applied to the receiving device are the same as shown in FIG. 5.

Figure 7:
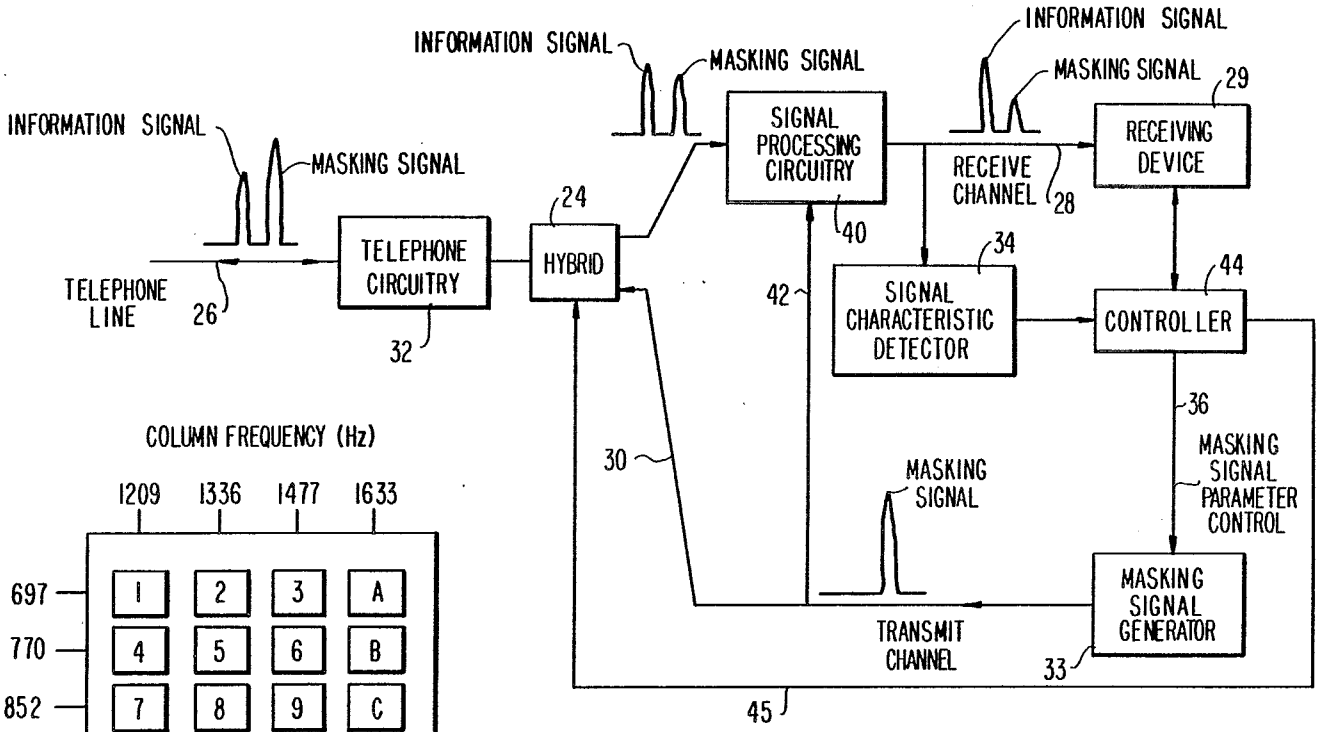

The embodiment of FIG. 7 combines the features of the embodiments shown in FIGS. 5 and 6. Signal characteristic detector 34 is provided to govern the amplitude of the masking signal which is applied to the transmit channel 30. In addition, the more sophisticated form of signal processing circuitry 40 is used to further reduce the level of the masking signal which appears at the receive-only port of the hybrid circuit. In addition, the amplitude of the masking signal generated by masking signal generator 33 is controlled by a controller 44, in accordance with information extracted from the receiving device 29 concerning the amplitude of the information signal, as more fully described below.

In general, it has been found that using a single frequency for blocking eavesdropping DTMF detectors does not provide the most reliable or consistent results. (However, as described below, a number of different frequencies can be used sequentially, each for a short period of time, during a single DTMF digit, in order to comply with FCC requirements concerning allowable signal levels on the telephone lines). Theoretically, two row or two column frequencies would block detection because detectors must detect only one row and one column frequency for proper operation. Experimentally, it was found that the use of frequencies corresponding to two rows and one column provides better results, but optimum performance was achieved with masking frequencies corresponding to two row and two column tones. In general, more tones created more confusion for the eavesdropping detectors. However, another important consideration is that to provide security for DTMF signaling the level of the masking tones should be close to the level of the DTMF signals to provide confusion or blocking at the eavesdropping DTMF detector. Having four masking tones (as compared to less than four) results in a greater probability of having some of the masking tones close to the level or above the level of the incoming information signal. This is all due to the variable nature of the hybrid rejection, as more fully described below.

More specifically, the masking signal for DTMF coding can be achieved by transmitting two row frequency tones. (See FIG. 8.) A masking signal of one row frequency at the proper level would block detection of digits in the other three rows. For example, if the masking signal is the row 1 frequency (697 Hz), digits in the other three rows (2, 3, 4) would not be decoded because there would be two row tones present and this would represent an invalid DTMF signature. If the masking signal is the row 4 frequency (941 Hz), digits in rows 1, 2, 3 would not be decoded. Therefore, if two row tones are used as the masking signal, all digits will be blocked from detection. It has been found that the row 1 and row 4 frequencies are the best choices; this combination produces uniform blocking for all digits. [Some frequencies which differ considerably from row and column frequencies have been found effective as masking signals. However, they have not thus far provided consistent masking for eavesdropping devices.]

There are two types of DTMF detectors. In the first type, detection is based only on valid DTMF row and column frequencies being present. In the second type, detection is based on valid row and column frequencies being present with the added requirement that energies other than row and column frequencies not be present. Detectors of the second type monitor these energies to discriminate between speech and proper DTMF signaling. If frequencies other than row and column frequencies are present, the decoders assume that the waveforms are speech generated and will not capture a DTMF digit. This provides another means to confuse certain types of DTMF detectors. Frequencies other than row and column frequencies can be generated as masking signals to confuse eavesdropping DTMF detectors.

Masking signals consisting of row and column or non-row and non-column frequencies can be continuous non-varying interference tones. However, sophisticated eavesdropping devices may be capable of identifying these masking signals and subtracting them out from the composite signal. Therefore, to keep the eavesdropping devices confused as to what the masking signal actually is, the masking signal may be varied over time in frequency, amplitude and/or phase. A random pattern is best for the receiving end to transmit. A random pattern is difficult for eavesdropping detectors to predict and therefore they are more likely to lose the information signal. For DTMF coding, masking signal generator 33 preferably varies the frequency between row and column frequencies, out-of-band frequencies and other in-band frequencies.

Another concept for masking signals in DTMF coding is to actually transmit valid DTMF frequency pairs. These valid DTMF pairs produce invalid DTMF signatures when mixed with the DTMF pairs of the sending device. Significantly, at quiet times (at the sending end) when there are no transmitted DTMF pairs, the valid DTMF masking signals cause the eavesdropping detectors to capture invalid information. By causing the eavesdropping detectors not only to fail to capture the valid information but also to capture invalid information, the security protection may be even more effective.

FSK (frequency shift keying) and PSK (phase shift keying) encoded information may utilize a different encoding method. In FSK encoding transmission, the masking signal is centered around the carrier frequencies. The masking signal may actually cancel out the information on the telephone line, yet be recreated at the receiving end in the hybrid/signal processing circuits (since the transmitted masking signal would be subtracted from a "null signal" to produce the original information signal). In PSK encoding transmission, the masking signal may distort the phase changes of the information signal, thus producing invalid phase transitions for the eavesdropping detectors. The masking signal would also be centered around the carrier frequency to create distortion of the original information signal. In every case, generator 33 is adapted, as described, in accordance with the type of encoding used.

The concept of the masking signal varying with time in frequency and/or amplitude and/or phase is applicable to both FSK and PSK encoding transmissions. This technique keeps the eavesdropping detectors from determining what the masking signals are and then being able to subtract them out as well.

Voice represents another encoding method. With voice recognition devices, information is transmitted to machines to control operations through regular speech. The concept of transmitting a masking signal from the receiving end applies to this transmission as well. This process would be half-duplex as a masking signal would be transmitted during incoming human speech, yet would be disabled as speech is transmitted from the receiving end to a human at the sending end. Masking signals may be created to accomplish distortion of the incoming speech for two applications, one for eavesdropping voice recognition devices and the other for eavesdropping humans. Masking signals needed to confuse voice recognition devices would alter the frequency spectrum and/or pitch of the incoming composite voice signal. To confuse eavesdropping humans, masking signals would sweep the frequency range with high amplitudes to override in volume the incoming speech, or add and subtract to the incoming signal to cause drop-outs. The concept of masking signals varying with time in frequency and/or amplitude and/or phase is applicable to voice transmission as well.

Figure 9:
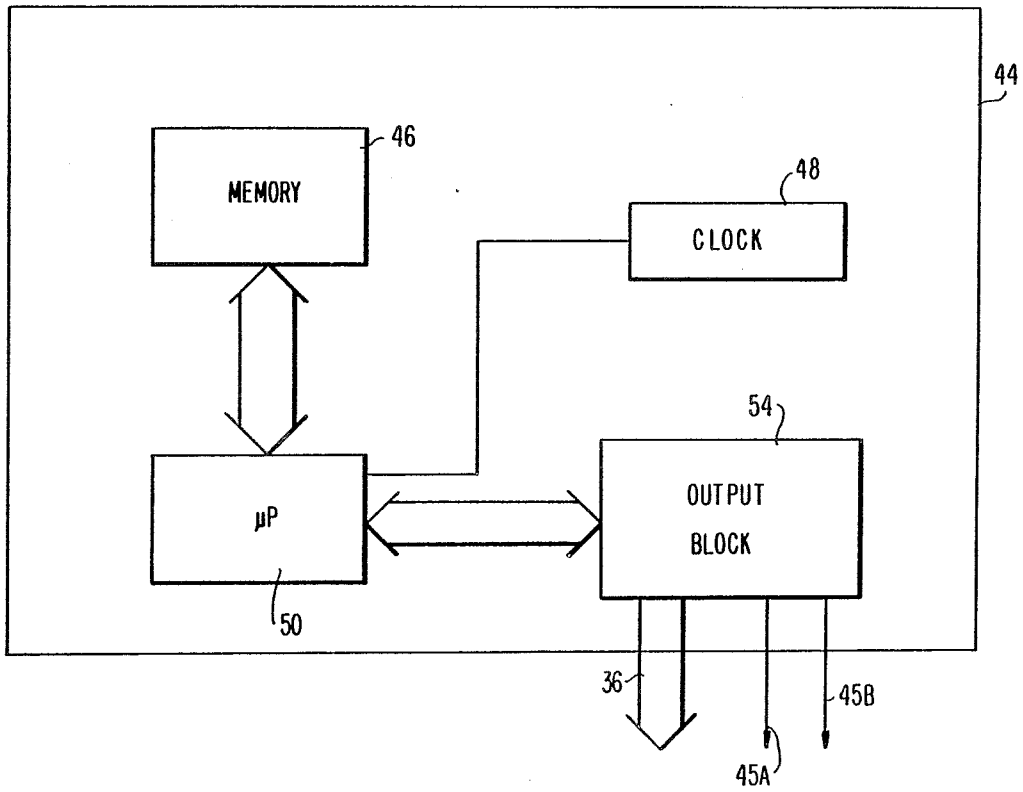
FIG. 9 is a block diagram of a possible configuration for the controller of FIG. 4 to FIG. 7.

FIG. 9 illustrates a block diagram of the controller 44 which is used to control the characteristics of the masking signal. The controller may have this general arrangement regardless of which masking signal is used. The digital representation of the information signal that is produced by signal masking characteristic detector 34 is applied to an input port of a microprocessor 50 driven by a clock 48.

A first portion of a memory 52 (a RAM) associated with microprocessor 50 is used to store the digitized information provided to microprocessor 50 so that appropriate software computations can be performed as described below. Another portion of memory 52 is used to store the program which controls the calculations. Output ports of microprocessor 50 are provided to output block 54. Block 54 utilizes the outputs of microprocessor 50 to generate appropriate outputs on bus 36 to provide control data for masking signal generator 33. Outputs are also provided on lines 45A and 45B to hybrid 24 to allow adaptation to the impedance of line 26, as more fully described below.

In the preferred embodiments described above which utilize DTMF information signals, it is the amplitude of the masking tones which is controlled. The incoming information signal is monitored during a quiet time when it is the only signal present on receive channel 28. The data is sampled for six milliseconds thus providing 48 samples at the above-mentioned 8,000 samples per second and is digitally rectified (the sign bit is removed). The values are then added together and divided by the total number of samples so that an average voltage value (representative of average energy) can be computed.

While these manipulations are performed in software, it will be recognized by one skilled in the art that it is possible to design hardware to perform similar processing of the data.

Figure 10:
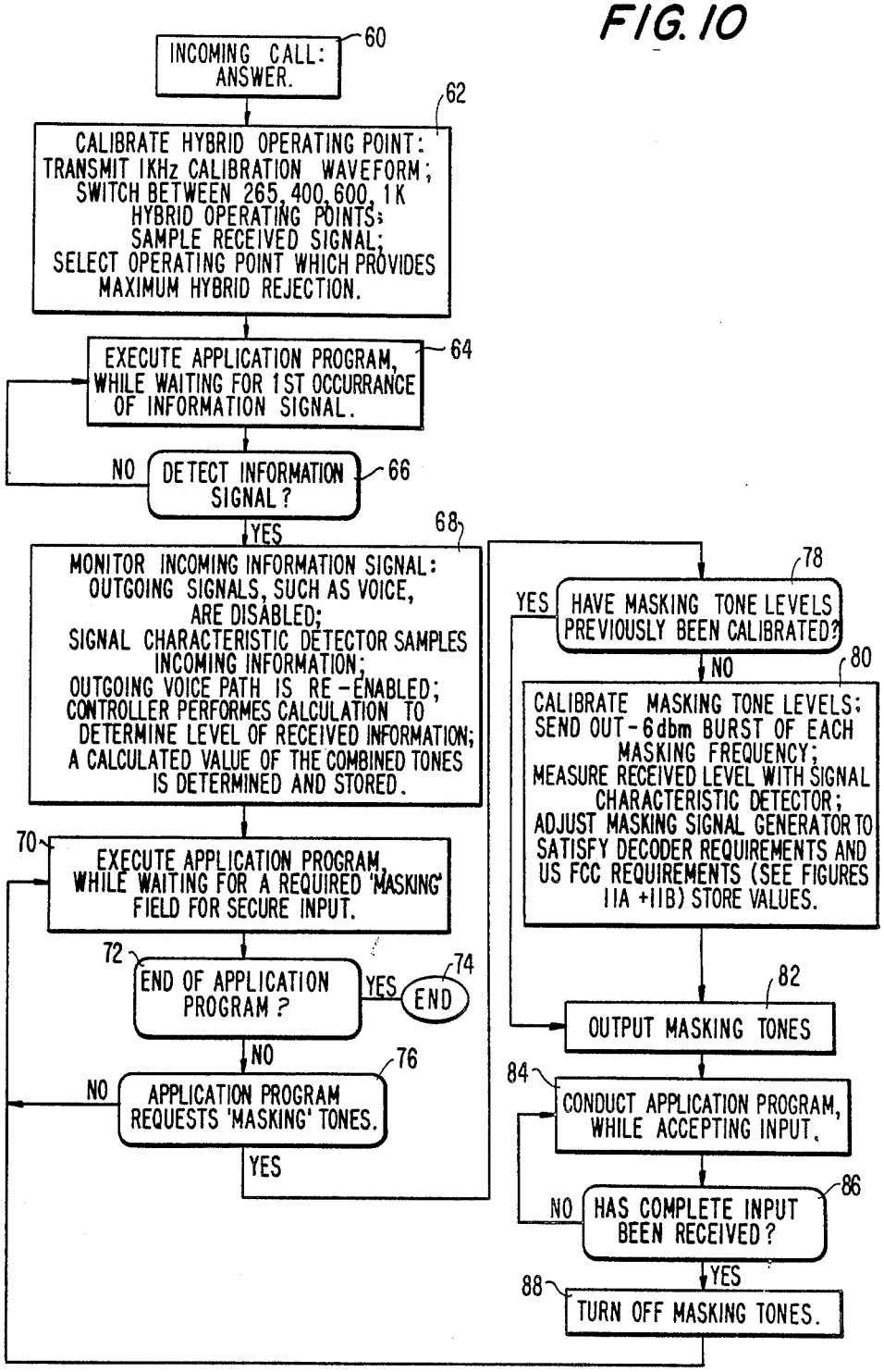
FIG. 10 is a high level logic flow chart of a typical implementation of the invention.

FIG. 10 provides an overview of the manner in which the present invention may be implemented in a particular application which may include, for example, a voice response system such as that sold under the registered trademark INFOBOT by the assignee of the present invention. Referring specifically to FIG. 10, at step 60 an incoming call is answered. At step 62 the operating point of hybrid 24 is selected. Most telephone hybrids 24 are designed for a nominal impedance of the telephone line of 600 ohms. These telephone hybrid designs have a typical inverted "U" shaped rejection versus impedance curve, with maximum rejection occurring at the top of the inverted "U" for a line whose impedance is 600 ohms. Therefore, if the telephone line impedance varies from 600 ohms, the hybrid rejection would be poor, thus reducing the "security" of the masking tones. It has been found that telephone line impedances vary from over a range of at least 1500 ohms to 600 ohms and therefore one hybrid "operating point" at 600 ohms does not allow security. Also provisions were made in the hybrid operating points for impedances below 600 ohms in case of multiple off-hook extensions. Thus, the characteristics of the hybrid, as noted above, can be modified during the course of the communication to accommodate change in line impedance.

Hybrid 24, under control of the signals on lines 45A and 45B from controller 44, varies the position of its characteristic curve along the impedance axis to optimize isolation for the particular impedance of the telephone line. A portion of the program stored in memory 52 allows microprocessor 50 to perform the necessary tests and computations to provide the proper output for correctly adjusting hybrid 24. Each operating point is tested, and that point which provides the greatest attenuation of masking signals at the receive port of hybrid 24 is selected. As shown in FIG. 13, four possible hybrid operation points are provided. The operation of an adaptive hybrid in accordance with the invention is described below with respect to FIG. 12.

At step 64 the application program is executed. For example, voice or other signals may be sent along telephone line 26 to notify the user to transmit his PIN or other identifying information. At step 66 the application program waits to detect the information. When it is finally detected, the sequence of events outlined at step 68 occurs.

The incoming information signal is monitored. Outgoing signals such as voice are disabled, and signal characteristic detector 34 samples the incoming information. The outgoing voice path is then re-enabled and the controller 44 performs calculations to determine the level of the received information. A calculated value for the combined tones is determined and stored in the manner previously described. [The analog signal is digitized into eight bit mu-law format, full wave rectified by removing the sign bit, and the values of the remaining seven bits are averaged.]

At step 70, the application program progresses; that is, parts of the program that do not require secure inputs are executed. At step 72, a determination is made as to whether the program has reached its end. If it has, then branching to step 74 terminates processing. If not, the program continues on to step 76 where a determination is made as to whether masking tones are required. If no masking tones are required, the program loops back to step 70. However, when a point is reached where masking tones are required, the program continues on to step 78 where a determination is made as to whether the masking tone levels have previously been calibrated. If the answer to this inquiry is no, then masking tone levels are calibrated at step 80 (as more fully described below with respect to FIGS. 11A and 11B, but summarized within the box labelled 80 in FIG. 10). The masking tones are available as output at step 82.

If the inquiry of step 78 indicates that masking tone levels were previously calibrated, then branching from step 78 directly to step 82 occurs.

At step 84, the application program progresses further, while accepting masked input. At step 86 a determination is made as to whether all of the input that must be masked has been received. As long as the answer is no, branching to step 84 keeps on taking place. If the answer is yes, then masking tones are turned off at step 88 and branching to step 70 occurs.

Figure 11A:
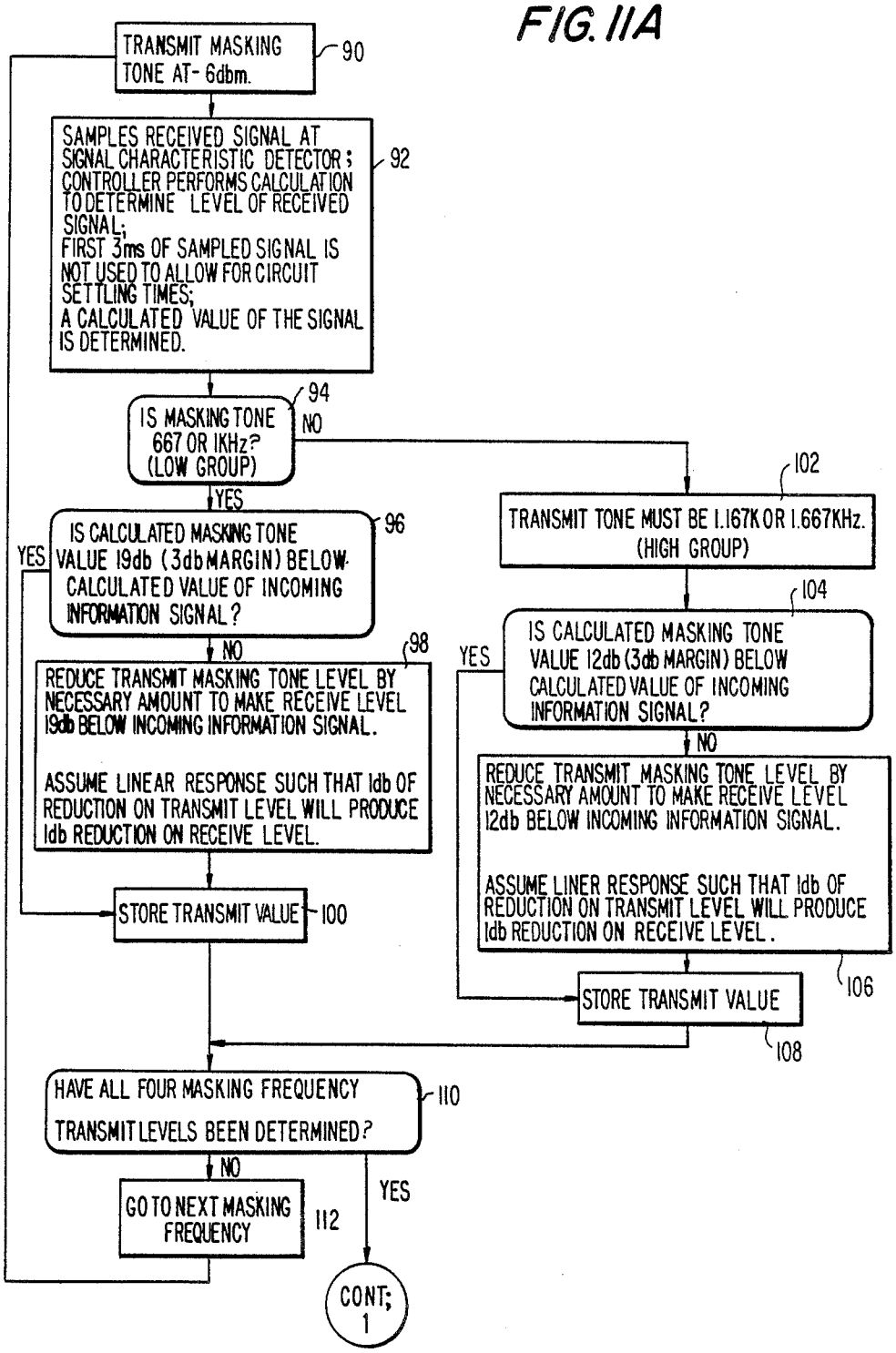
FIG. 11A is a first part of a flow chart of the level calibration procedure of the flow chart of FIG. 10.
Figure 11B:
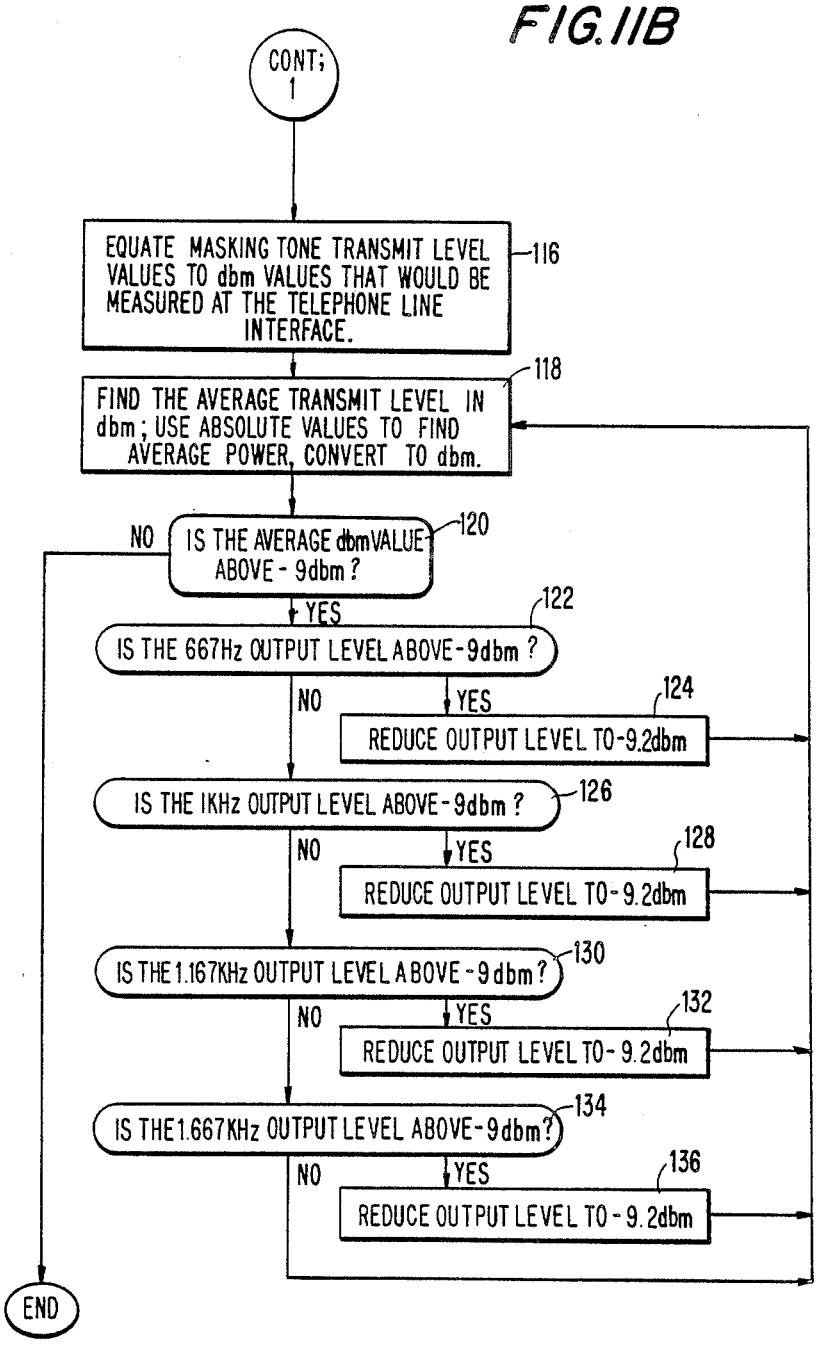
FIG. 11B is a second part of the same flow chart.

FIGS. 11A and 11B comprise a logic flowchart of certain operations performed under the control of controller 44 (those summarized in step 80 of FIG. 10).

Starting with step 90, a masking tone at a level of −6 dbm is transmitted for a period of nine milliseconds. At step 92 the received signal at signal characteristic detector 34 is sampled. Microprocessor 50 of controller 44 performs the calculations, described above, to determine the level of the received signal. The first three milliseconds of the received signal corresponding to the nine millisecond transmission is not used so as to allow for the circuits to settle and avoid transient amplitude variations. A calculated value of the masking tone level on the receive channel is determined as an average of the mu-law encoded full wave rectified amplitude waveform.

In the illustrated system, only four masking tones are used, 667 Hz and 1,000 Hz (the "low" tones), and 1167 and 1667 Hz (the "high" tones). As noted above, to comply with telecommunication agency requirements concerning allowable signal levels on telephone lines, these tones are applied sequentially during a single DTMF digit which is to be masked, as more fully described below. [The fact that some of these frequencies differ from nominal "nearby" DTMF tones is of no moment. These frequencies were selected for ease of implementation while still providing effective masking characteristics.]It has been found in one system tested that for proper DTMF detection, a single low frequency masking tone must be 16 db below the information signal level and a single high frequency masking tone must be 9 db below the information signal level. For a 3 db safety margin, the two "low" masking tone levels must be at −19 db levels and the "two" high masking tones must be at −12 db levels.

At step 94 a determination is made as to whether the masking tone is in the row (or low frequency) group. If it is, at step 96 a determination is made as to whether the calculated masking tone level is 19 db below the calculated value of the incoming information signal (determined in step 68 of FIG. 10).

The 19 db margin referred to above is the necessary difference between the incoming information signal and a masking tone for proper reception on the receive channel 28. For the illustrative embodiment the characteristic of concern is the difference in amplitude level between the incoming information and masking tone at any given time. For other systems, frequency, phase, etc. might be the characteristic that must have a necessary margin for proper reception at the receiving end.

A predetermined margin which for a specific DTMF detector permits reliable DTMF detection may be empirically determined. For example, when using four masking frequencies, two low frequencies at 667 and 1000 Hz, and two high frequencies at 1167 and 1667 Hz, it was found that, as described above, for the specific DTMF decoder being used (a Mitel MT8870) the low frequencies must be 16 db below the low group tone in the incoming DTMF signal if only one low frequency masking tone is present but 19 db below the low group tone in the incoming DTMF signal if both low frequency masking tones are present and of equal amplitude (giving rise to a necessary level of −22 db if there is to be a 3 db safety margin). It was also found that while the high frequencies must be 9 db below the high tone in an incoming DTMF signal if only one high frequency masking tone is present, each masking tone must be 13 db below the high tone of an incoming DTMF signal if both high frequency masking tones are present and of equal amplitude. One can ignore the effect of the high frequency tones on the low frequency DTMF tones and vice versa due to band splitting that occurs in DTMF receivers. Where four masking frequencies are sequenced one at a time, levels of −16 db and −9 db are required since only one interfering frequency is present at the input of the DTMF detector. (Typically, the masking tone is switched every 48 milliseconds or so, although switching on a random time basis can add to the confusion of an eavesdropping device. Since the tones for a single DTMF digit will generally be present on the line for a period of time greatly in excess of 48 milliseconds, each digit will, over its duration, be masked by several different tones.)

At step 98 the transmitted masking tone level is reduced by the necessary amount to assure that the received signal level is 19 db below the incoming information signal. A linear response is assumed so that 1 db of reduction in the transmit level will produce a corresponding 1 db reduction in the receive level. The transmit values are stored in step 100.

Step 98 represents the process that adjusts the amplitude level of masking signal generator 33 so that the necessary margins discussed above for proper reception on receive channel 28 are met. This process must be performed on a per call basis. The reason for this is that changes occur which have an effect on the path from the transmit channel 30 to the receive channel 28. It has been found that relative rejection between two masking tones may vary by as much as 10 db between calls and as a function of frequency. Even though a calibrated level is provided by masking signal generator 33, the level at the receiving channel 28 will change based on the specific routing within the phone system. Because the necessary margin for proper reception needs to be guaranteed, the levels of the masking tones on the receive channel 28 must be calibrated with respect to the level of the incoming DTMF information determination early in the processing.

In one calibration scheme, all masking frequencies are transmitted and the resulting waveform is received at signal characteristic detector 34. The resultant waveform is digitized and the digital information is analyzed by software for a combined energy calculation. The level of the transmitted signal is adjusted by the controlling software until the necessary margin for the receive channel 28 is met.

However, this method calibrates the combined frequency waveform, and not the individual frequency margins. This method does not necessarily provide reliable incoming DTMF detection because the empirically determined margin for the low frequency group and the margin for the high frequency group are not being calibrated individually.

The preferred procedure is to use the masking signal generator 33 to transmit the masking tones individually, in succession, and to monitor each resultant signal at the receive channel 28 with signal characteristic detector 34. Once again, the waveforms are digitized for software analysis.

With this method, loud tones of short duration may be used to offset noise effects. Each frequency is transmitted for 9 ms at −6 dbm and the resultant level on the receive channel 28 is monitored at signal characteristic detector 34. The resultant signal is digitized, and the digital information is analyzed for energy content.

This analysis essentially computes the rejection of hybrid 24 for each particular tone (when a particular telephone line is used), since the transmit level is known. Having already determined the level of the incoming information signal, and having just measured the hybrid attenuation for a particular masking tone, the transmitted level of the masking tone can be adjusted at masking signal generator 33 to a level that will satisfy the necessary margin for proper DTMF detection on receive channel 28. The controlling software can easily determine the amount of adjustment based on this information.

The new computed transmit level of the masking tone is not checked for compliance with the necessary margin requirements since the masking tone level at the signal characteristic detector 34 may be below the noise floor (due to attenuation by hybrid 24). All four masking tones are calibrated in this manner.

| | | |
|---|---|---|
| If: | Incoming Information = | X dbm |
| | Necessary Margin = | Y db |
| | Measured Masking Tone = (at DTMF Detector) | Z dbm |

Then: Z must equal X-Y for proper operation.

As an example, if Z is measured 6 db over the value of X-Y, then the masking signal generator 33 is adjusted 6 db down in level for that frequency. A different level adjustment is generally required for each masking frequency. In the preferred embodiment, masking signal generator 33 is software based. A preferred software implementation utilizes a table to determine the level of the signals produced by masking signal generator 33. A pointer specifies an entry in the table. The entries correspond to increments of approximately 0.5 dB. When a value has been specified, it is stored in a buffer. Thus, the levels of the masking tones are controlled by software by utilizing a new digital value from the table. A D/A function may be performed by the same chip that is used to implement A/D converter 46, a technique known in the art, to translate digital values to an analog signal to be placed on the transmit channel 30.

Thus, at step 98 the masking tone level has been calibrated to guarantee proper decoding by the receiving unit 20. At step 100 this value is stored for subsequent checks for telecommunication agency requirements.

If, at step 94, the masking tone is in the high frequency group, branching to step 102 occurs. At step 104 a determination is made as to whether the calculated masking tone level is 12 db below the calculated value of the incoming information signal to provide a 3 db margin of safety. If it is not, the masking tone level is reduced at step 106 in a manner similar to the reduction at step 98. If the 3 db margin is present, branching occurs to step 108 where the transmit values are stored. At step 110 a determination is made as to whether all four masking frequency levels have been specified. If not, branching to step 112 occurs, followed by branching to step 90. If all four masking frequency levels have been determined then branching to step 116 (FIG. 11B) occurs. The masking tone levels are then adjusted for compliance with telecommunication agency regulations.

In accordance with United States Federal Communications Commission requirements, as specified in 48 C.F.R. (Part 68.308), "the maximum power of other than live voice signals delivered to a loop simulator circuit shall not exceed −9 db with respect to one milliwatt, when averaged over any three-second interval." Since in the illustrative embodiment the masking tones are transmitted over an undefined input field length continuously in succession, there is no "on/off" duty cycle time to take advantage of. For example, when the user is a human being (rather than an electronic apparatus) there is no way to know how long each DTMF digit will be present. Further, the number of digits transmitted for a particular input field may vary from call to call. Since each individual masking tone is calibrated, some may be above the −9 dbm limit and others may be below the limit. This can satisfy the requirement as long as the average is below the −9 dbm limit.

This limit may or may not pose problems depending on the specific application. Some schemes may take advantage of transmitting the masking tones at very high levels if "on/off" duty cycles can be used.

In the preferred embodiment, the levels of the four calibrated masking tones are checked to see if the average energy is below the −9 dbm limit. If the average is not, one frequency at a time is lowered to a −9.2 dbm level (if the specific masking tone is above the −9 dbm level) and the average is checked again. This continues until the average meets the −9 dbm limit. There can be many other variations in adjusting for an average that will meet the required limit. However, in the final condition, the transmitted masking tone energy must average below the −9 dbm limit within any three second interval.

At step 116 the masking tone transmit level values are equated to the dbm values that would be measured at the telephone line interface. In other words, the look-up table discussed above is accessed. At step 118, the average transmit level in dbm is determined. The dbm levels are converted to absolute values. These numerical values are then averaged. The numerical average is then converted back to a corresponding dbm level. This sequence is necessary because the corresponding dbm value cannot simply be averaged to determine the average dbm level.

As noted above, at step 120 a determination is made as to whether the average dbm value is above −9 dbm. If it is, at step 121 a determination is made as to whether the 667 Hz output is above that level. If it is, branching to step 124 occurs, where the output level of the 667 Hz masking tone is reduced to −9.2 dbm. Then branching back to step 118 occurs. If the answer to the inquiry of step 120 is no, then branching to step 126 occurs where the output level of the 1 kHz masking tone is checked. If it is above −9 dbm, then branching to step 128 occurs, where it is reduced and a further determination is made at step 118. If the 1 kHz level is not above −9 dbm then branching to step 130 occurs, where the level of the 1.167 kHz output is checked. If the 1.167 kHz tone is at a level above −9 dbm, then branching to step 132 occurs, for a reduction in its output level to −9.2 dbm. This is followed by branching to step 118. If the output level of the 1.167 kHz tone at step 130 is not above −9 dbm, then branching to step 134 occurs where a similar determination is made with respect to the 1.667 kHz output. If it is above −9 dbm, branching to step 136 occurs for a reduction in the output level of the 1.667 kHz tone to −9.2 dbm, and a determination of the average transmit level at step 118. If the output level at step 134 is not above −9 dbm branching occurs, in any event, to step 118.

Each time step 118 is executed step 120 follows. The first time that the average dbm value is determined not to be above −9 dbm, the portion of the program described with respect to FIG. 11B ends, as the masking levels comply with agency requirements.

Figure 12:
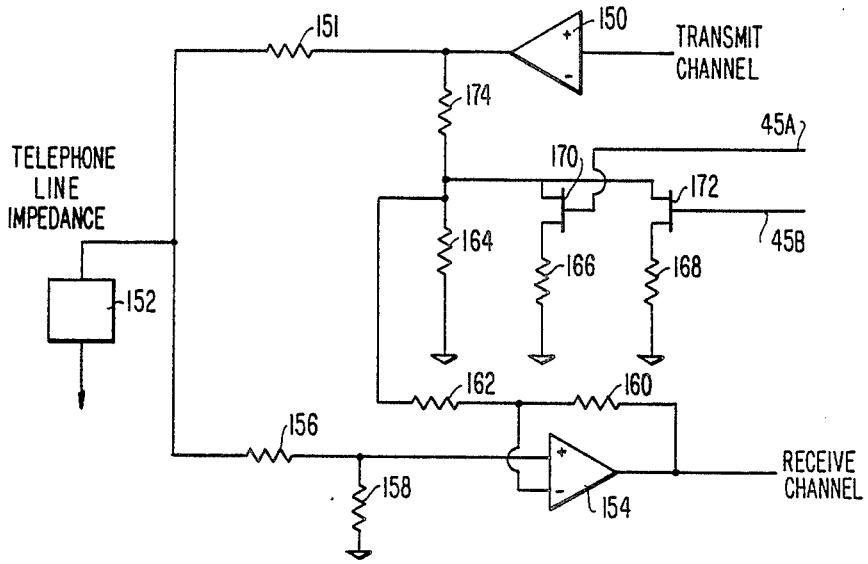
FIG. 12 is a schematic diagram of an adaptive hybrid device according to the invention.
Figure 13:
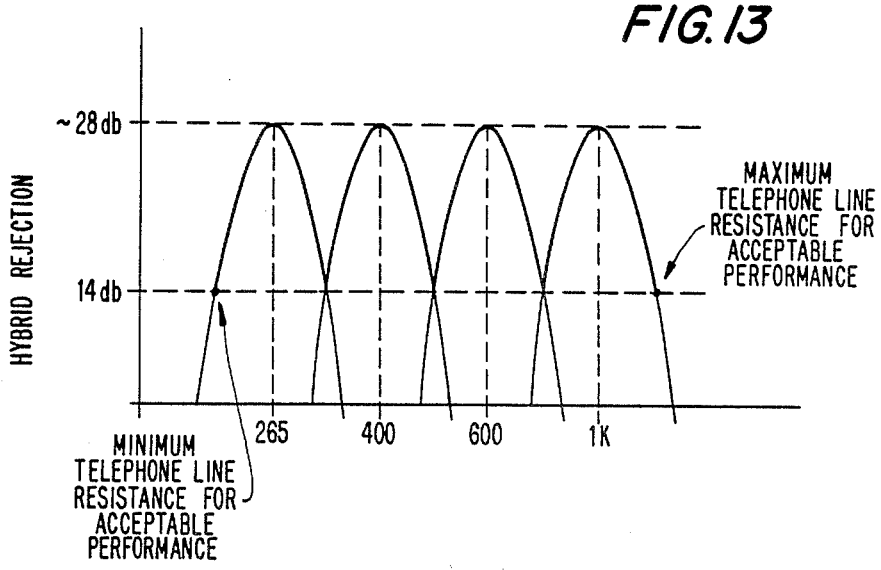
FIG. 13 illustrates a series of curves of rejection versus impedance for various operating points of the hybrid of FIG. 12.

FIG. 12 illustrates the adaptive hybrid according to the invention. For simplicity, the telephone impedance is represented as a resistor although in practice it is generally a complex impedance. The circuit of FIG. 12 does not compensate for phase shifts introduced by the telephone line impedance.

A transmit amplifier 150 is coupled through a resistor 151 to the telephone line, represented for simplicity, by resistor 152. Telephone line 152 is coupled to the non-inverting input of a receive channel amplifier 154 through a resistor 156 which together with resistor 158 forms a voltage divider. The gain of amplifier 154 is determined by a feedback resistor 160 and the resistance to ground from the inverting input of amplifier 154. The resistance to ground is determined basically by resistor 162 since the resistance of resistor 164 is negligible in comparison.

Signals from the output of transmit amplifier 150 reach the inverting input of amplifier 154 by way of a resistor 174 connected between the output of amplifier 150 and the junction of resistors 162 and 164. These transmitted signals are subject to voltage division as described below. The logic states of control lines 45A and 45B, which control the respective gates of FET switch 170 and FET switch 172 as governed by microprocessor 50, determine the gain of receive channel amplifier 154 for signals from amplifier 150.

With control line 45A and control line 45B both at logic low levels the hybrid is set for the highest level of telephone line impedance or 1 kohm. Voltage division of the signal from amplifier 150 is determined by the ratio of the value of resistor 164 to the sum of the values of resistor 164 and resistor 174, knowing that resistor 162 has a negligible effect because its resistance value is much larger than that of resistor 164.

When control line 45A is at logic high and control line 45B is at a logic low the hybrid is optimized for a 600 ohm telephone line impedance. Voltage division of the signal from amplifier 150 is determined by the ratio of the resistance of the parallel combination of resistor 164 and resistor 166 divided by the resistance of the parallel combination of resistor 164 and resistor 166 plus the value of resistor 174.

When control line 45A is at logic low and control line 45B is at a logic high the hybrid is optimized for a 400 ohm telephone line. Voltage division of the signal from amplifier 150 is determined by the ratio of the resistance of the parallel combination of resistor 164 and resistor 168 to the resistance of the parallel combination of resistor 164 and resistor 168 added to the resistance of resistor 174.

With control lines 45A and 45B both at a logic high level the hybrid is optimized for a telephone line of 265 ohms. Voltage division of the signal from amplifier 150 is determined by the ratio of the resistance of the parallel combination of resistors 164, 166 and 168 to the parallel combination of those resistors plus that of resistor 174.

FIG. 13 illustrates the inverted "U" shaped curves discussed above with one curve being shown for each of the four values for which the circuit of FIG. 12 is optimized. At all telephone line impedance values between 250 ohms and 1500 ohms the hybrid provides at least 14 db of rejection of the transmit signal on the receive channel, if the proper operating point is selected. This is done, under software control as described above with respect to step 62 of FIG. 10, by switching to the various operating states, and choosing the one which provides the best rejection for the call being handled.

Although the invention has been described with reference to particular embodiments, it is to be understood that these embodiments are merely illustrative of the application of the principals of the invention. For example, facsimile transmission utilizes voiceband signals and intelligent interception of facsimile transmissions may be prevented by transmitting a masking signal from the receiving end of the communications path. Thus it is to be understood that numerous modifications may be made in the illustrative embodiments of the invention and other arrangements may be devised without departing from the spirit and scope of the invention.

We claim:

1. In a communications system for interconnecting first and second sites over a two-direction line, an apparatus for preventing intelligible interception of tone encoded information signals transmitted over said line in at least one direction from said first site to said second site but allowing intelligible reception of said tone encoded information signals at said second site comprising means for sensing the amplitude of said tone encoded information signals at the second site; means at said second site for injecting a masking signal on said line; means at said second site for extracting tone encoded information signals received on said line from said first site which are superimposed on said masking signal; means for attenuating the amplitude of said masking signal received by said extracting means; means for measuring the amplitude of said masking signal at said extraction means after attenuation by said attenuating means; and means for adjusting the amplitude of said injected masking signal so that the level thereof at said extraction means relative to the measured level of said tone encoded information signals at the extraction means allows extraction of said tone encoded information signals in the presence of said masking signal while enhancing confusion in an eavesdropping detector which may be connected to said line.

2. The apparatus of claim 1, wherein said adjusting means adjusts an initial amplitude of said injected masking signal to be higher than that required for masking, and subsequently reduces the amplitude of said injected masking signal.

3. The apparatus of claim 1 further comprising means for delaying sensing of the amplitude of said tone encoded information signals by said sensing means for a predetermined period of time after commencement of said tone encoded information signals to allow sensing to occur after transient changes in the amplitude of said tone encoded information signals due to transmission over said line have ceased.

4. The apparatus of claim 1 wherein said injecting means comprises means for sequentially generating a series of masking tones.

5. The apparatus of claim 4 wherein said adjusting means adjusts the amplitudes of the masking tones in said series to have an overall average energy content no greater than a predetermined energy value.

6. The apparatus of claim 4 wherein said adjusting means includes means for sequentially adjusting the amplitudes of said masking tones, means for determining the average energy content of said masking tones after each sequential adjustment, and means for terminating adjustment of further masking tones after a sequential adjustment has reduced the average energy so that it is no greater than a predetermined value.

7. The apparatus of claim 1 wherein said attenuating means comprises a three-port device; a first transmit-receive port of which is connected to said line, a second transmit port to which said masking signal injecting means is connected, and a third receive port to which said extracting means is connected; said device exhibiting substantially higher attenuation between said second and third ports than between both said first and second ports, and said first and third ports; and means for selectively adjusting said three-port device in accordance with the impedance of said line so as to substantially maximize said attenuation between said second port and said third port.

8. The apparatus of claim 7 wherein said selective adjusting means exhibits a plurality of discrete adjustment points, and further comprising means for determining which of said adjustment points provides maximum attenuation.

9. A method, for use in a communications system interconnecting first and second sites over a two-direction line, for preventing intelligible interception of tone encoded information signals transmitted over said line in at least one direction from said first site to said second site but allowing intelligible reception of said tone encoded information signals at said second site, comprising the steps of sensing the amplitude of said tone encoded information signals at the second site; injecting a masking signal on said line at said second site; measuring the amplitude of said masking signal at an extraction point at said second site; extracting at said second site tone encoded information signals received on said line from said first site which are superimposed on said masking signal; and adjusting the amplitude of said injected masking signal so that the level thereof at said extraction point relative to the measured level of said tone encoded information signal at said extraction point allows extraction of said tone encoded information signal in the presence of said masking signal while enhancing confusion in an eavesdropping detector which may be connected to said line.

10. The method of claim 9 wherein the amplitude of said injected masking signal is adjusted to be initially greater than that required for masking, and wherein the amplitude is subsequently reduced.

11. The method of claim 9 further comprising the step of delaying sensing of the amplitude of said tone encoded information signals for a predetermined period of time after commencement thereof to allow sensing to occur after transient changes in the amplitude of said tone encoded information signals due to transmission over said line have ceased.

12. The method of claim 9 wherein said masking signal is comprised of a sequence of individual masking tones.

13. The method of claim 12 wherein the amplitudes of said masking tones are adjusted individually so that said masking tones have an average energy content no greater than a predetermined energy value.

14. The method of claim 13 wherein the amplitudes of individual ones of said masking tones are sequentially adjusted and, further comprising the steps of determining after each adjustment the average energy content of the masking signal, and terminating adjustment after a sequential adjustment has reduced the average energy so that it is no greater than a predetermined energy value.

15. The method of claim 9 wherein said communications system includes means for attenuating the injected masking signal at said extraction point, and further comprising the step of adjusting said attenuation means to provide optimum attenuation of said injected masking signal in response to variations in impedance of said two-direction line.

16. The method of claim 9, wherein the amplitude of said masking signal is adjusted so that a given margin in amplitude is maintained at said second site between the level of tone encoded information signals and the level of said masking signal.

* * * * *